US006385966B2

(12) United States Patent
Zhang

(10) Patent No.: US 6,385,966 B2
(45) Date of Patent: May 14, 2002

(54) METHOD FOR REGENERATING AN $NO_X$ STORAGE CATALYST

(75) Inventor: Hong Zhang, Tegernheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/757,330

(22) Filed: Jan. 9, 2001

Related U.S. Application Data

(63) Continuation of application No. PCT/DE99/01907, filed on Jul. 1, 1999.

(30) Foreign Application Priority Data

Jul. 9, 1998 (DE) ..... 198 30 829

(51) Int. Cl.[7] ..... F01N 3/00

(52) U.S. Cl. ..... 60/274; 60/276; 60/277; 60/295; 204/412; 204/424; 204/425; 204/426; 204/429; 205/781

(58) Field of Search ..... 60/274, 276, 277, 60/285, 295, 297; 204/412, 424, 425, 426, 427, 428, 429; 205/781

(56) References Cited

U.S. PATENT DOCUMENTS 4,927,517 A 5/1990 Mizutani
5,554,269 A * 9/1996 Joseph et al. ..... 204/424
5,667,652 A * 9/1997 Liu et al. ..... 204/412
5,686,654 A * 11/1997 Friese et al. ..... 73/23.32
5,877,406 A * 3/1999 Kato ..... 73/23.31
6,012,282 A * 1/2000 Kato et al. ..... 60/274
6,301,878 B1 * 10/2001 Zhang et al. ..... 60/274

FOREIGN PATENT DOCUMENTS

| | | |
|---|---|---|
| DE | 195 11 548 A1 | 6/1996 |
| DE | 196 40 161 A1 | 4/1998 |
| DE | 197 05 335 C1 | 9/1998 |
| EP | 0 597 106 A1 | 5/1994 |
| EP | 0 598 917 A1 | 6/1994 |
| EP | 0 636 770 A1 | 2/1995 |
| EP | 0 814 248 A2 | 12/1997 |

OTHER PUBLICATIONS

Nobuhide Kato et al.: "Performance of Thick Film NOx Sensor on Diesel and Gasoline Engines", 1997 Society of Automotive Engineers, Inc., pp. 199–206.

* cited by examiner

*Primary Examiner*—Thomas Denion
*Assistant Examiner*—Binh Tran
(74) *Attorney, Agent, or Firm*—Laurence A. Greenberg; Werner H. Stemer; Gregory J. Mayback

(57) ABSTRACT

The time profile of the output signal of an NOx measurement transducer arranged downstream of the NOx storage catalyst is used, during and after the regeneration phase, to derive a criterion as to whether the quantity of regeneration agent to be supplied to the NOx storage catalyst in a regeneration phase must be changed in order to achieve an optimum action of the exhaust-gas purification system. The output signal is picked off at the amperometric NOx measurement transducer at two electrodes. The measurement transducer exhibits the two-position behavior necessary for the method.

11 Claims, 3 Drawing Sheets

Start

Calculate sums FL1,FL2
S1
Threshold values SW1, USW2, OSW2 from memory
S2
FL1>SW1 and USW2<FL2<OSW2 ?
S3
yes
No regulating action
S4
FL1>SW1 and FL2<USW2 ?
S5
yes
Case A
S6
FL1>SW1 and FL2>OSW2 ?
S7
yes
Case B
S8
FL1<SW1 ?
S9
yes
Case C
S10
End
S11

METHOD FOR REGENERATING AN $NO_X$ STORAGE CATALYST

CROSS-REFERENCE TO RELATED APPLICATION

This is a continuation of copending International Application PCT/DE99/01907, filed Jul. 1, 1999, which designated the United States.

BACKGROUND OF THE INVENTION

1. Field of the Invention

The invention lies in the field of internal combustion engines. More specifically, the invention relates to a method of regenerating a NOx (nitrogen oxide) storage catalyst which is arranged in the exhaust tract of an internal combustion engine that is operated with air excess. A NOx measurement transducer is arranged downstream of the storage catalyst. In a regeneration phase, the catalyst converts stored NOx catalytically, with the addition of a reducing agent, the reducing agent being produced by the internal combustion engine being operated briefly with a rich air/fuel mixture (i.e., lambda<1).

In order to reduce the fuel consumption of gasoline internal combustion engines further, internal combustion engines with lean combustion are used with increasing frequency. In order to fulfil the exhaust-gas emission limit values required, special exhaust-gas aftertreatment is necessary in such internal combustion engines. NOx storage catalysts are used for this purpose. These NOx storage catalysts, because of their coating, are capable, during a storage phase, of absorbing from the exhaust gas NOx compounds which occur in the case of lean combustion. During a regeneration phase, the absorbed or stored NOx compounds are converted into harmless compounds by the addition of a reducing agent. The reducing agent used for lean-burn gasoline internal combustion engines may be CO, $H_2$ and HC (hydrocarbons). These are produced by the internal combustion engine being operated briefly with a rich mixture and are made available to the NOx storage catalyst as exhaust-gas components, with the result that the stored NOx compounds in the catalyst are broken down.

Efficiency of such an NOx storage catalyst depends essentially on optimum regeneration. If the quantity of regeneration agent is too low, the stored NOx is not sufficiently broken down, this being detrimental to the efficiency with which NOx is absorbed from the exhaust gas. If the quantity of regeneration agent is too high, although optimum NOx conversion rates are achieved, there is nevertheless an inadmissibly high emission of reducing agent. The optimum quantity of regeneration agent fluctuates over the service life of a vehicle. The possible cause of this may be seen in the change in the NOx mass flow emitted by the internal combustion engine. Another reason is the change in storage capacity of the catalyst, which decreases, for example, due to the storage of sulfate, since sulfur present in the fuel is burnt to form $SO_2$, is oxidized into sulfate by the catalyst with air excess and is stored by the coating in a similar way to $NO_2$. However, the binding of sulfate in the store is substantially greater. During a regeneration phase, however, sulfate is not converted, but remains bound in the NOx storage catalyst. With increasing sulfate storage, therefore, the capacity of the NOx storage catalyst decreases.

A commonly assigned German patent application DE 197 05 335 describes a method for triggering a sulfate regeneration for an NOx storage catalyst, in which a sulfate regeneration phase is carried out at predetermined points in time. When sulfate regeneration is triggered, not only the quantity of stored sulfate, but also the thermal aging of the NOx storage catalyst is taken into account.

European published patent application EP 0 597 106 A1 discloses a method for regenerating an NOx storage catalyst, in which the quantity of NOx compounds which is absorbed by the NOx storage catalyst is calculated as a function of operating data of the internal combustion engine. When a predetermined limit quantity of NOx stored in the NOx storage catalyst is exceeded, a regeneration phase is initiated. This does not, however, ensure that the exhaust-gas emission limit values are adhered to reliably.

In order to check the NOx storage catalyst, an NOx measurement transducer is normally arranged downstream of the catalyst. Such a measurement transducer is known, for example, from N. Kato et al., "Performance of thick film NOx sensor on diesel and gasoline engines", Society of Automotive Engineers, Publication No. 970858.

SUMMARY OF THE INVENTION

The object of the present invention is to provide a method of regenerating a NOx storage catalyst which overcomes the above-noted deficiencies and disadvantages of the prior art devices and methods of this general kind, and in which the regeneration of an NOx storage catalyst is carried out in such a way that the latter is operated with optimum efficiency.

With the above and other objects in view there is provided, in accordance with the invention, a method of regenerating a NOx storage catalyst of the type arranged in an exhaust tract of an internal combustion engine operated with air excess, wherein a NOx measurement transducer is disposed downstream of the Nox storage catalyst in an exhaust gas flow direction, the method which comprises:

- during a regeneration phase, briefly operating the internal combustion engine with a rich air/fuel mixture to produce a reducing agent and catalytically converting NOx stored in the Nox storage catalyst with the addition of the reducing agent;
- providing an amperometric NOx measurement transducer formed with a solid-state electrolyte and having a first measuring cell, a second measuring cell, a reference electrode exposed to ambient air, a first electrode, a second electrode, and an outer electrode;
- measuring an oxygen concentration in the first measuring cell via a first Nernst voltage between the first electrode and the reference electrode and regulating the oxygen concentration with a first oxygen-ion pumping current between the first electrode and the outer electrode;
- measuring an oxygen concentration in the second measuring cell via a second Nernst voltage between the second electrode and the reference electrode; and
- with the first and second measuring cells connected in series, picking off a voltage between the outer electrode and the reference electrode, and detecting an output signal dependent on the oxygen concentration and exhibiting two-position behavior during the regeneration phase; and
- deriving from a time profile of the output signal a criterion as to whether the quantity of regeneration agent must be changed in order to achieve optimum regeneration of the NOx storage catalyst.

In other words, in the regeneration phase, a signal picked off at an NOx measurement transducer is evaluated in order to establish whether the quantity of regeneration agent was optimum. The signal used for this purpose is picked off at an amperometric NOx measure transducer. This signal reproduces the lambda value or the oxygen concentration in the exhaust gas and has two-position behavior, that is to say, in the range of lambda=1, the signal changes sharply in the case of low lambda changes.

In accordance with an added feature of the invention, two sum values are formed as criterion, with:

a first sum value being calculated from the output signal scanned at a specific frequency, from a start of regeneration until a predetermined threshold value is exceeded;

a second sum value being calculated from the output signal scanned at the specific frequency, from a point when the threshold value is exceeded until the sum value falls below the threshold value;

comparing the sum values with associated threshold values; and determining the quantity of regeneration agent in dependence on a result of the comparison.

In accordance with an additional feature of the invention, the determining step comprises selectively keeping the quantity of regeneration agent constant, increasing the quantity of regeneration agent, or reducing the quantity of regeneration agent in dependence on the result of the comparison.

In accordance with another feature of the invention, the quantity of regeneration agent is kept constant when the first sum value is higher than a threshold value and the second sum value is within a range delimited by a lower threshold value and an upper threshold value.

In accordance with yet another feature of the invention, the quantity of regeneration agent is increased when the first sum value is higher than a threshold value and the second sum value is lower than a lower threshold value.

In accordance with again another feature of the invention, the quantity of regeneration agent is reduced when the first sum value is higher than a threshold value and the second sum value is higher than an upper threshold value.

In accordance with a further feature of the invention, the quantity of regeneration agent is increased by extending the regeneration phase.

In accordance with again a further feature of the invention, the quantity of regeneration agent is reduced by shortening the regeneration phase.

In accordance with yet an added feature of the invention, the method comprises shortening a duration of a storage phase of the NOx storage catalyst, during which the internal combustion engine is operated with air excess, and carrying out sulfate regeneration for the storage catalyst when the sum value is lower than the threshold value.

In accordance with yet an additional feature of the invention, the output signal is corrected as a function of the first oxygen-ion pumping current, to compensate for an error voltage stemming from a transition resistance through which the first oxygen-ion pumping current flows.

In accordance with a concomitant feature of the invention, the output signal is corrected in dependence on the temperature of the measurement transducer.

In a preferred embodiment of the method, the quantity of regeneration agent to be supplied to the NOx storage catalyst is matched to the optimum value. Since a greatly reduced reducing agent requirement stems from a fallen storage capacity of the NOx storage catalyst, preferably sulfate regeneration can be carried out when the storage capacity has fallen too sharply.

The advantage which can be achieved by means of the invention is therefore, in particular, that the optimum quantity of regeneration agent is supplied over the entire service life of the vehicle.

Other features which are considered as characteristic for the invention are set forth in the appended claims.

Although the invention is illustrated and described herein as embodied in a method for regenerating an NOx storage catalyst, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
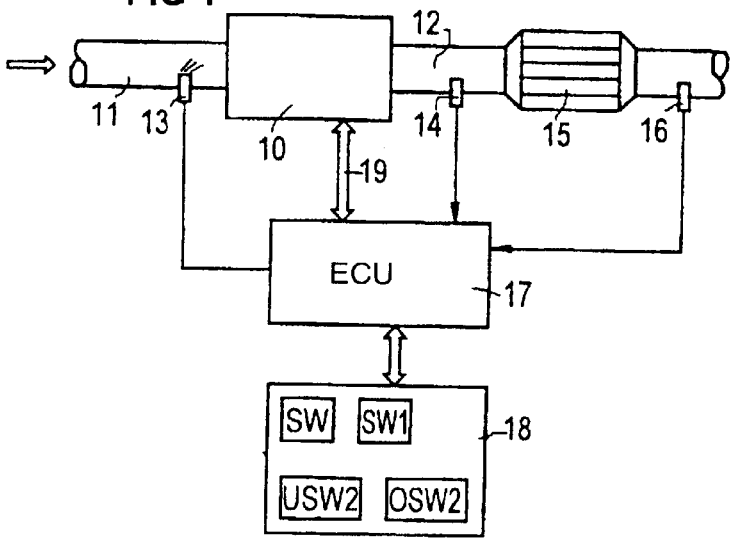
FIG. 1 is a diagrammatic illustration of an internal combustion engine with an NOx storage catalyst.

Referring now to the figures of the drawing in detail and first, particularly, to FIG. 1 thereof, there is seen a block diagram showing an internal combustion engine with an exhaust-gas after-treatment system, in which the method is employed. Only those parts and components that are necessary for understanding the invention are illustrated.

An internal combustion engine 10 has an intake tract 11 and an exhaust tract 12. A fuel metering device, of which only an injection valve 13 is illustrated diagrammatically, is present in the intake tract 11. A precatalyst lambda probe 14, an NOx storage catalyst 15 and, downstream of this, an NOx measurement transducer 16 are provided in the exhaust tract 12. With the aid of the precatalyst lambda probe 14, the air/fuel ratio in the exhaust gas upstream of the NOx storage catalyst 15 is determined. The NOx measurement transducer 16 serves, inter alia, for checking the NOx storage catalyst 15. The operation of the internal combustion engine 10 is regulated by an operational control unit 17 (ECU—engine control unit) having a memory 18, in which, inter alia, a plurality of threshold values are stored. The operational control unit 17 is connected to further measurement transducers and actuators via a data and control line 19 illustrated diagrammatically.

Depending on the operating mode of the internal combustion engine 10, consideration being given here, in particular, to lambda-1-regulated operation, homogeneous-lean operation and stratified-lean operation, the NOx storage catalyst 15 may also have three-way properties in the case of air/fuel ratios near lambda=1, or, instead of an NOx storage catalyst 15, a device consisting of two catalysts, an NOx storage catalyst and a three-way catalyst, may also be provided.

Figure 4:
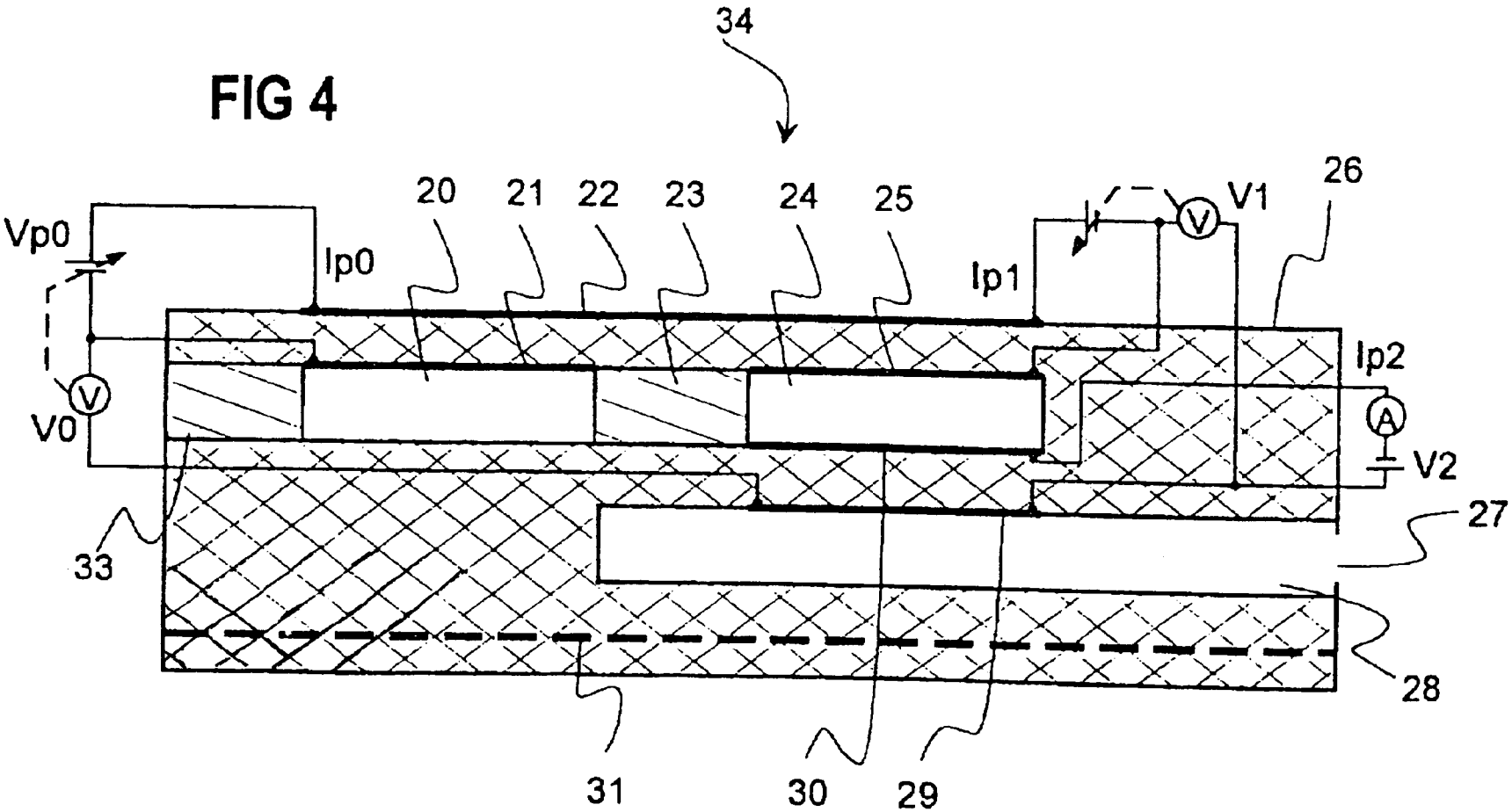
FIG. 4 is a diagrammatic sectional illustration through an NOx measurement transducer.

The NOx measurement transducer 16 present downstream of the NOx storage catalyst 15 is an amperometric measurement transducer. It is illustrated in more detail under reference symbol 34 in a diagrammatic sectional illustration in FIG. 4. The transducer 16 consists of a solid-state electrolyte 26, for example $ZrO_2$, and contains the exhaust gas to be measured which is supplied via a diffusion barrier 33. The exhaust gas diffuses through the diffusion barrier 33 to a first measuring cell 20. The oxygen content in the measuring cell 20 is measured via a first Nernst voltage V0 between a first electrode 21 and a reference electrode 29 exposed to ambient air. The first electrode 21 may also have a multipart design or be designed with a plurality of pickoffs. The two electrodes 21, 29 are conventional platinum electrodes. The reference electrode 29 is arranged in an air duct 28, into which ambient air passes via an orifice 27.

The measurement value of the first Nernst voltage V0 is used for setting a regulating voltage Vp0. The regulating voltage Vp0 drives a first oxygen-ion pumping current Ip0 through the solid-state electrolyte 26 between the first electrode 21 and an outer electrode 22. The control action, illustrated by a broken line, of the first Nernst voltage V0 on the regulating voltage Vp0 results in the oxygen-ion pumping current Ip0 being set such that a specific oxygen concentration or a specific oxygen partial pressure is present in the first measuring cell 20.

The first measuring cell 20 is connected to a second measuring cell 24 via a further diffusion barrier 23. The gas present in the first measuring cell 20 diffuses through this diffusion barrier 23. As a result of diffusion, a correspondingly lower second oxygen concentration or oxygen partial pressure is established in the second measuring cell 24.

This second oxygen concentration, in turn, is measured via a Nernst voltage V1 between a second electrode 25, which is likewise a conventional platinum electrode, and the reference electrode 29 and is used for regulating a second oxygen-ion pumping current Ip1. The second oxygen-ion pumping current Ip1 from the first measuring cell 20 flows from the second electrode 25 through the solid-state electrolyte 26 to the outer electrode 22. With the aid of the second Nernst voltage V1, the second oxygen-ion pumping current Ip1 is regulated such that a specific, low, second oxygen concentration is present in the second measuring cell 24.

The NOx not affected by the previous processes in the measuring cells 20 and 24 is then decomposed at the measuring electrode 30, which is designed to be catalytically active, by the application of the voltage V2, and the released oxygen, as a measure of the NOx concentration at the measuring electrode 30 and therefore in the exhaust gas to be measured, is pumped in a measuring stream Ip2 toward the reference electrode 29.

The following voltage is thereby generated in the first measuring cell 20:

$$U_{firstmeasuringcell} = \frac{RT}{4F} \cdot (\ln P_{01,\,firstmeasuringcell} - \ln P_{01,\,exhaustgas}) + R0 \cdot Ip0 \tag{1}$$

in which $P_{01,\,first\ measuring\ cell/exhaust\ gas}$ is the oxygen partial pressure in the first measuring cell or the exhaust gas, R is the gas constant, T is the absolute gas temperature, F is the Faraday constant, R0 is a transition resistance between the first electrode 21 and the solid-state electrolyte 26, and Ip0 is the first oxygen-ion pumping current.

The following voltage is obtained in the second measuring cell:

$$U_{secondmeasuringcell} = \frac{RT}{4F} \cdot (\ln P_{02,\,ambientair} - \ln P_{02,\,secondmeasuringcell}) \tag{2}$$

in which $P_{02,\,ambient\ air/second\ measuring\ cell}$ is the oxygen partial pressure in the ambient air and in the second measuring cell, respectively.

By the differential voltage being picked off between the outer electrode 22 and the reference electrode 29, the two measuring cells 20 and 24 are connected in series, so that, in a first approximation, with a sufficiently homogeneous temperature of the NOx measurement transducer 34, a sufficiently low current Ip0 and a sufficiently identical oxygen partial pressure at the pickoffs of the inner electrode 21, the following relation is obtained:

$$\begin{aligned} U_{two-position} &= \frac{RT}{4F} \cdot (\ln P_{02,ambientair} - \ln P_{02,secondmeasuringcell} + \\ &\quad \ln P_{01,firstmeasuringcell} - \ln P_{01,exhaustgas}) \\ &= \frac{RT}{4F} \cdot (\ln P_{02,ambientair} - \ln P_{01,exhaustgas}) \end{aligned}$$

This relation describes the two-position behavior of a lambda probe. This differential voltage between the outer electrode 22 and the reference electrode 29 is used as an output signal US for the method for regenerating an NOx storage catalyst.

The measuring error caused in equation (1) by the transition resistance R0 in the voltage in the first measuring cell 20 can advantageously be corrected. For this purpose, a specific resistance value is assumed and Ip0-dependent compensation is carried out. Furthermore, advantageously, a correction of the output signal US as regards the temperature of the measurement transducer 34 may be carried out.

Figure 2:
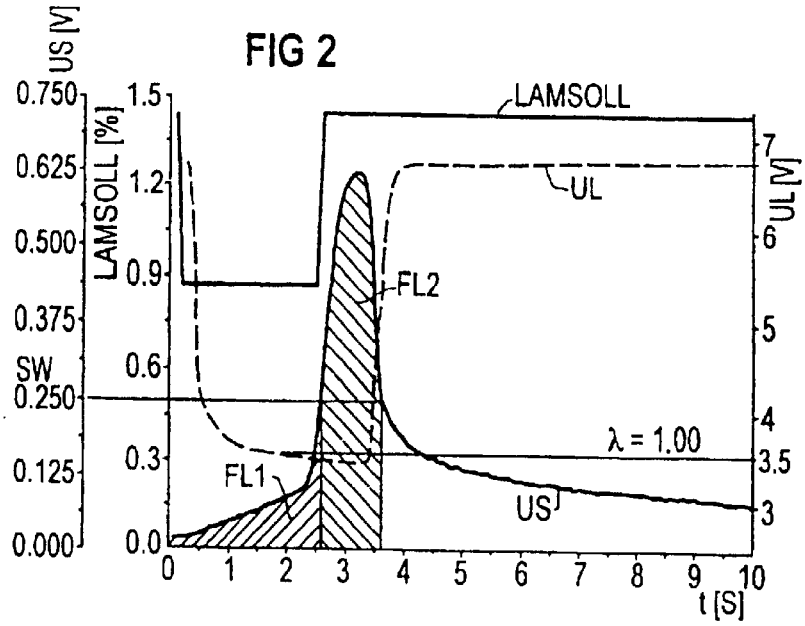
FIG. 2 is a graph with the time profile of the output signal during the regeneration of the NOx storage catalyst, the signal being picked off at the NOx measurement transducer.

FIG. 2 shows the time profile of the output signal US of the NOx measurement transducer 16 during the regeneration phase of the NOx storage catalyst 15.

This illustration also depicts the profile of the precatalyst lambda desired value LAMSOLL.

The precatalyst lambda desired value LAMSOLL jumps from a value in the lean range (lambda=1.4) to a value for a rich mixture (lambda=0.85) at the start of the regeneration phase of the NOx storage catalyst 15. After the conclusion of the regeneration phase, the internal combustion engine 10 is operated with lean combustion again.

At the end of the storage phase preceding the regeneration phase, the output signal US is at about 0.03 V. At the start of the regeneration phase, this voltage rises continuously. Toward the end of the regeneration phase, the lambda value UL at the NOx measurement transducer 16 downstream of the NOx storage catalyst 15 falls below 1 and the output signal US rises steeply. UL subsequently rises again to values for a lean mixture and US falls again. In order to determine whether the quantity of regeneration agent supplied to the NOx storage catalyst 15 in a regeneration phase is optimum, the following procedure is adopted:

Two sum values are calculated. A first sum value FL1 is calculated from the output signal US scanned at a specific frequency (for example, 100 Hz), from the start of the regeneration phase until a threshold value SW (for example, 0.25 V) is exceeded. This sum value corresponds to the area characterized by the reference symbol FL1 in FIG. 2. A second sum value FL2 is calculated from the output signal US scanned at the same frequency, from the point when the threshold value SW is exceeded until said sum value subsequently falls below the threshold value SW again. This sum value corresponds to the area characterized by the reference symbol FL2 in FIG. 2. The areas FL1 and FL2 may, of course, also be formed by continuous integration, instead of by summing.

The optimum quantity of regeneration agent was supplied to the NOx storage catalyst 15 when the sum value FL2 is higher than a threshold value SW1 and the sum value FL2 is between a lower threshold value USW2 and an upper threshold value OSW2.

Figure 3:
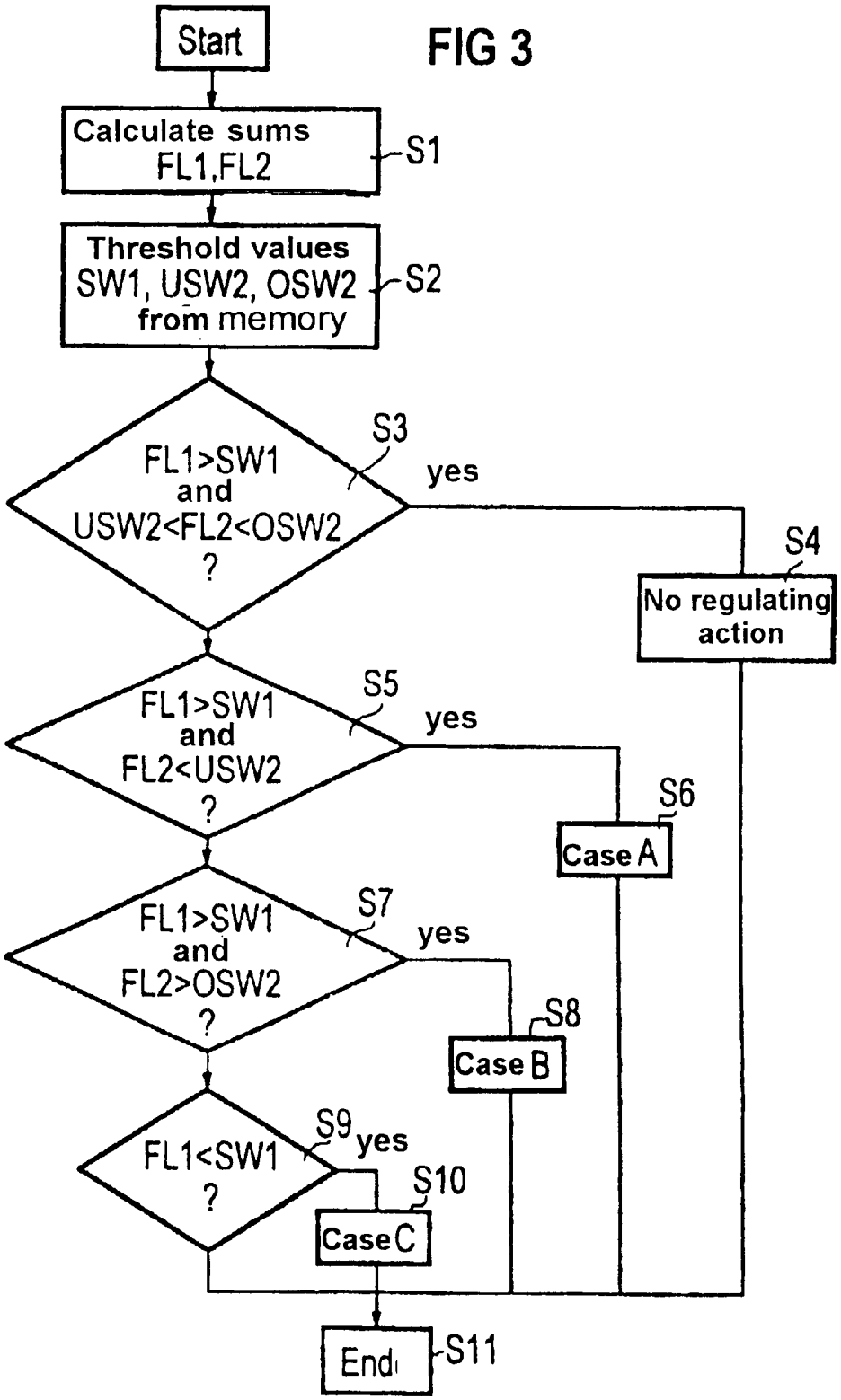
FIG. 3 is a flowchart detailing the method.

FIG. 3 illustrates a flowchart determining the optimum quantity of regeneration agent. First, the sum values or areas FL1 and FL2 are calculated and intermediately stored (step S1). Subsequently, the threshold value SW1 for the sum value FL1 and the threshold values USW2 and OSW2 for the sum value FL2 are read out from the memory 18 of the operational control unit 17 (step S2).

A check is then made as to whether the quantity of regeneration agent supplied is optimum (step S3). This is so when the sum value FL1 is above the threshold value SW1 and the sum value FL2 is within the range delimited by the lower threshold value USW2 and by the upper threshold value OSW2. When these two conditions are satisfied (step S4), no action is necessary, the quantity of regeneration agent used was optimum and the method is terminated (step S11).

If it becomes clear that these two conditions are not satisfied (step S3), an nonoptimum quantity of regeneration agent was supplied to the NOx storage catalyst 15 in the regeneration phase. Depending on the sum values FL1, FL2, it is then possible to determine whether the quantity of regeneration agent must be increased or reduced, in order to achieve optimum regeneration of the NOx storage catalyst 15. For this purpose, a check is first made as to whether the sum value FL1 is above the threshold value SW1 and the sum value FL2 is below the lower threshold value USW2 (step S5). If this is so, the quantity of regeneration agent is too small and must be increased (step S11, case A). The increase in the quantity of regeneration agent may, in this case, take place by the air ration being varied during the regeneration phase in the rich direction. Alternatively, the regeneration phase may also be carried out for longer, this, as a rule, being preferable, since the variation of the lambda value in the regeneration phase is possible only within narrow limits (for example, between 0.75 and 0.85). When a larger quantity of regeneration agent has been set for the following regeneration phases, the method is terminated (step S11).

If it becomes clear in step 5 that the sum value FL1 is below the threshold value SW2 and the sum value FL2 is above the lower threshold value USW2, a check is made as to whether the sum value FL1 is above the threshold value SW2 and the sum value FL2 is above the upper threshold value OSW2 (step S7). In that case, the quantity of regeneration agent is too large and must be reduced (step S8, case B). The reduction in the quantity of regeneration agent can take place in a similar way to the increase in case A. When a smaller quantity of regeneration agent has been stored for future regeneration phases of the NOx storage catalyst 15, the method is terminated (step S11).

If it becomes clear in step S7 that the sum value FL1 is not above the threshold value SW1 and the sum value FL2 is not above the upper threshold value OSW2, a check is first made as to whether the special case FL1=SW1 is present (step S9). If this is so, no control action is necessary and the method is terminated (step S11). If this is not so, the sum value FL1 must be below the threshold value SW1 (step S10). The result of this is that the storage capacity of the NOx storage catalyst 15 has fallen (case C). In order to achieve optimum conversion behavior of the exhaust system, the storage phase must therefore be shortened. This may take place, for example, by a reduction of the storage capacity used in a computational catalyst model. The threshold value SW1 must likewise be lowered. When the threshold value SW1 falls below a lower threshold value during the useful life of the internal combustion engine 10, this means that the catalyst capacity has reached a minimum value, which may be brought about, for example, by sulfate storage. In this case, preferably, sulfate regeneration is required and is carried out, as described by way of example in German patent application 197 05 335. After sulfate regeneration has taken place, the threshold value SW1 can be set to the initial value again.

The threshold values SW, SW1, USW2, OSW2 mentioned are determined on a test stand.

I claim:

1. A method of regenerating a NOx storage catalyst of the type arranged in an exhaust tract of an internal combustion engine operated with air excess, wherein a NOx measurement transducer is disposed downstream of the Nox storage catalyst in an exhaust gas flow direction, the method which comprises:

during a regeneration phase, briefly operating the internal combustion engine with a rich air/fuel mixture to produce a reducing agent and converting NOx stored in the Nox storage catalyst with the addition of the reducing agent;

providing an amperometric NOx measurement transducer formed with a solid-state electrolyte and having a first measuring cell, a second measuring cell, a reference electrode exposed to ambient air, a first electrode, a second electrode, and an outer electrode;

measuring an oxygen concentration in the first measuring cell via a first Nernst voltage between the first electrode and the reference electrode and regulating the oxygen concentration with a first oxygen-ion pumping current between the first electrode and the outer electrode;

measuring an oxygen concentration in the second measuring cell via a second Nernst voltage between the second electrode and the reference electrode; and with the first and second measuring cells connected in series, picking off a voltage between the outer electrode and the reference electrode, and detecting an output signal dependent on the oxygen concentration and exhibiting two-position behavior during the regeneration phase; and deriving from a time profile of the output signal a criterion as to whether the quantity of regeneration agent must be changed in order to achieve optimum regeneration of the NOx storage catalyst.

2. The method according to claim 1, which comprises forming two sum values as criterion, wherein a first sum value is calculated from the output signal scanned at a specific frequency, from a start of regeneration until a predetermined threshold value is exceeded;

a second sum value is calculated from the output signal scanned at the specific frequency, from a point when the threshold value is exceeded until the sum value falls below the threshold value;

comparing the sum values with associated threshold values; and determining the quantity of regeneration agent in dependence on a result of the comparison.

3. The method according to claim 2, wherein the determining step comprises selectively keeping the quantity of regeneration agent constant, increasing the quantity of regeneration agent, or reducing the quantity of regeneration agent in dependence on the result of the comparison.

4. The method according to claim 2, which comprises keeping the quantity of regeneration agent constant when the first sum value is higher than a threshold value and the second sum value is within a range delimited by a lower threshold value and an upper threshold value.

5. The method according to claim 2, which comprises increasing the quantity of regeneration agent when the first sum value is higher than a threshold value and the second sum value is lower than a lower threshold value.

6. The method according to claim 2, which comprises reducing the quantity of regeneration agent when the first sum value is higher than a threshold value and the second sum value is higher than an upper threshold value.

7. The method according to claim 5, which comprises increasing the quantity of regeneration agent by extending the regeneration phase.

8. The method according to claim 6, which comprises reducing the quantity of regeneration agent by shortening the regeneration phase.

9. The method according to claim 1, which comprises shortening a duration of a storage phase of the NOx storage catalyst, during which the internal combustion engine is operated with air excess, and carrying out sulfate regeneration for the storage catalyst when the sum value is lower than the threshold value.

10. The method according to claim 1, which comprises correcting the output signal as a function of the first oxygen-ion pumping current, to compensate for an error voltage stemming from a transition resistance through which the first oxygen-ion pumping current flows.

11. The method according to claim 1, which comprises correcting the output signal as a function of the temperature of the measurement transducer.

* * * * *